US006939086B2

(12) United States Patent
Nishiumi et al.

(10) Patent No.: US 6,939,086 B2
(45) Date of Patent: Sep. 6, 2005

(54) METAL SHEET PILE

(75) Inventors: Kenji Nishiumi, Futtsu (JP); Shinji Taenaka, Futtsu (JP); Masataka Tatsuta, Chiyoda-ku (JP); Yousuke Miura, Futtsu (JP); Kazuhiko Eda, Chiyoda-ku (JP); Humitaka Maeda, Chiyoda-ku (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/673,141

(22) Filed: Sep. 30, 2003

(65) Prior Publication Data

US 2004/0101370 A1 May 27, 2004

(30) Foreign Application Priority Data

Nov. 15, 2002 (JP) ..... 2002-331761
Jul. 31, 2003 (JP) ..... 2003-204491

(51) Int. Cl.[7] ..... E02D 5/08
(52) U.S. Cl. ..... 405/277; 405/278
(58) Field of Search ..... 405/276, 277, 405/278, 279, 280, 281

(56) References Cited

U.S. PATENT DOCUMENTS 1,019,227 A * 3/1912 Desoer ..... 405/280
5,447,393 A * 9/1995 Yeates et al. ..... 405/276
6,443,664 B1 * 9/2002 Horan et al. ..... 405/279

FOREIGN PATENT DOCUMENTS

| | | | |
|---|---|---|---|
| AU | 15249/92 | A | 11/1992 |
| JP | 60-85326 | U | 6/1985 |
| JP | 2689794 | B2 | 8/1997 |
| JP | 2964933 | B2 | 8/1999 |
| JP | 11-336076 | A | 12/1999 |
| JP | 2002-522665 | A | 7/2002 |

OTHER PUBLICATIONS

Internet web page, (7 sheets), of www.europile.com describimg cold rolled steel sheet piling dated Oct. 3, 2002.* Profilarbed S.A., "Cold formed sheet piles" Online (XP002315806) Retreived from the Internet: URL:http://www.skylinesteel.com/documents/brochures/Cold_Formed_E.pdf; retrieved Jan. 27, 2005.

* cited by examiner

*Primary Examiner*—Michael Safavi
(74) *Attorney, Agent, or Firm*—Birch, Stewart, Kolasch & Birch, LLP

(57) ABSTRACT

In a metal sheet pile, an effective width B [mm], a flange width Bf [mm], a height H [mm] and a geometrical moment of inertia I [$cm^4/m$] meet the inequalities $700 \leqq B \leqq 1{,}200$; $280 \leqq Bf \leqq 0.0005 \times B^2 - 0.05 \times B$; and $-0.073 \times B + 0.0043 \times I + 230 \leqq H \leqq 380$. The metal sheet pile provides a better cross-sectional performance than a background art metal sheet pile.

8 Claims, 9 Drawing Sheets

| | NO. | EFFECTIVE WIDTH B[mm] | FLANGE WIDTH Bf[mm] | WEB WIDTH Bw[mm] | HEIGHT H[mm] | WEB ANGLE [DEGREE] | FLANGE THICKNESS t[mm] | UNIT WEIGHT W[kg/m2] | GEOMETRICAL MOMENT OF INERTIA I[cm4/m] | $0.0005B^2$ −0.05B−Bf | H+0.073xB −0.0043xI −230 | I−470W +38000 |
|---|---|---|---|---|---|---|---|---|---|---|---|---|
| EXAMPLE | 1 | 850 | 305 | 120 | 217 | 61.1 | 11.0 | 101.3 | 10313 | 13.75 | 4.7 | 702 |
| EXAMPLE | 2 | 900 | 340 | 110 | 215 | 62.9 | 11.0 | 101.6 | 10405 | 20 | 6.0 | 653 |
| EXAMPLE | 3 | 1000 | 410 | 90 | 210 | 66.8 | 11.0 | 101.9 | 10370 | 40 | 8.4 | 477 |
| EXAMPLE | 4 | 850 | 305 | 120 | 307 | 68.7 | 13.5 | 133.5 | 26412 | 13.75 | 25.5 | 1667 |
| EXAMPLE | 5 | 900 | 340 | 110 | 302 | 70 | 13.5 | 133 | 26171 | 20 | 25.2 | 1661 |
| EXAMPLE | 6 | 1000 | 400 | 100 | 300 | 71.6 | 13.5 | 131.7 | 26492 | 50 | 29.1 | 2593 |
| EXAMPLE | 7 | 1000 | 439 | 61 | 290 | 78.1 | 13.5 | 137.1 | 26456 | 11 | 19.2 | 19 |
| EXAMPLE | 8 | 900 | 290 | 196 | 230 | 48.0 | 11.0 | 95.0 | 10500 | 70 | 20.55 | 3850 |
| EXAMPLE | 9 | 900 | 340 | 124 | 300 | 66.0 | 13.0 | 127.0 | 24700 | 20 | 29.49 | 3010 |
| COMPARATIVE EXAMPLE | 10 | 1000 | 466 | 34 | 200 | 80.4 | 11 | 108.5 | 10334 | −16 | −1.4 | −2661 |
| COMPARATIVE EXAMPLE | 11 | 800 | 299 | 101 | 302 | 71.5 | 13.5 | 138.2 | 26516 | −19 | 16.4 | −438 |
| COMPARATIVE EXAMPLE | 12 | 850 | 337 | 88 | 297 | 73.5 | 13.5 | 138.1 | 26400 | −18.25 | 15.5 | −507 |
| COMPARATIVE EXAMPLE | 13 | 900 | 367 | 83 | 292 | 74.1 | 13.5 | 136.6 | 25724 | −7 | 17.1 | −478 |
| COMPARATIVE EXAMPLE | 14 | 800 | 312 | 88 | 210 | 67.3 | 11.0 | 106.1 | 10285 | −32 | −5.8 | −1582 |
| COMPARATIVE EXAMPLE | 15 | 850 | 351 | 74 | 207 | 70.3 | 11.0 | 106.7 | 10314 | −32.25 | −5.3 | −1835 |
| COMPARATIVE EXAMPLE | 16 | 900 | 390 | 60 | 205 | 73.7 | 11.0 | 107.4 | 10408 | −30 | −4.1 | −2070 |

FIG.7

METAL SHEET PILE

CROSS-REFERENCE TO RELATED APPLICATIONS

This nonprovisional application claims priority under 35 U.S.C. § 119(a) on patent application Ser. Nos. 2002-331761 and 2003-204491, filed in Japan on Nov. 15, 2002 and Jul. 31, 2003, respectively. The entirety of each of these applications is incorporated herein by reference.

BACKGROUND OF THE INVENTION

1. Field of the Invention

The present invention relates to a metal sheet pile used for earth-retaining structures, fundamental structures, bank protection structures and a water cut-off walls in the civil engineering and construction fields. In particular, the present invention relates to the shape of a hat-type metal sheet pile.

2. Description of Background Art

It should be noted that FIG. 1 illustrates the present invention; however, this figure will also be used below for explanation purposes to identify the various elements of a typical metal sheet pile according to the background art. In addition, it should be noted that this discussion is directed to the present inventors' analysis of the background art and should not be construed to be an admission of prior art.

Referring to FIG. 1, a hat-type metal sheet pile of the present invention includes a flange 2, a pair of webs 3, 3, a pair of arms 4, 4 and a pair of joints 5, 5. Each of the pair of webs 3, 3 is connected to a respective end of the flange 2 so as to be line-symmetric with each other. Each of the pair of arms 4, 4 is connected at one thereof to the other end of the pair of webs 3, 3, respectively. The pair of arms 4, 4 is parallel to the flange 2. Furthermore, each of the pair of joints 5, 5 is connected to the other end of the pair of arms 4,4, respectively.

FIG. 1 shows a hat-type metal sheet pile where an effective width is B [mm], a height is H [mm], a web width is Bw [mm], a flange width is Bf [mm] and a flange thickness is t [mm]. The effective width B is defined as a distance between an interfitting center of a left joint 5 and an interfitting center of right joint 5. The interfitting center is defined as a center position of an area where a joint of one sheet pile and a joint of adjacent sheet pile overlap to interfit or interlock in the width direction of the sheet piles to form a pair of interfitted or interlocked joints.

A hat-type metal sheet pile is typically manufactured by a well-known method, i.e., rolling a hot bloom or slab of a piece of metal, typically steel, which has been heated to about 1250° C. in a furnace in advance. The rectangular hot piece of steel is passed a number of times using grooved rolls, which have a complicated shape to form a final cross-section. The metal sheet pile having the final cross-section is cut-off to make a predetermined length product when at a high temperature and is then cooled down. Bending and/or a warping caused during the rolling process is/are eliminated by using a roller straightener or a press straightener.

Typical metal sheet piles are U-type metal sheet piles and a hat-type metal sheet piles. Outlines of U-type metal sheet piles and hat-type metal shape piles are shown in outline form in FIGS. 8A and 8B, respectively. In order to form a metal wall having a certain length, a plurality of metal sheet piles are interlocked with each other by interfitting the joints 5. Therefore, it is economically advantageous to reduce the number of metal sheet piles by increasing the effective width B [mm] of a single metal sheet pile. However the effective width of metal sheet piles according to the background art has been 600 mm at the maximum.

Metal sheet piles are required to have a certain cross-sectional rigidity according to the intended use of the metal sheet pile. Cross-sectional rigidity is represented by a geometrical moment of inertia I [$cm^4/m$] (=cross-sectional area×(distance to gravity-center axis of the metal sheet pile)$^2$). Generally a geometrical moment of inertia I is more than 6,000 [$cm^4/m$] (I>6,000 [$cm^4/m$]). If the cross-sectional rigidity is the same between two kinds of metal sheet pile, a metal sheet pile having a weight per unit area W [$kg/m^2$] smaller than the other metal sheet pile, i.e., the metal sheet pile having a better cross-section performance (I/W), is more economical than the other.

In view of the above, a metal sheet pile having more than a 700 mm effective width in order to reduce the number of sheet piles used and a metal sheet pile having a cross-sectional performance better than metal sheet piles according to the background art has been longed for.

SUMMARY OF THE INVENTION

An object of the present invention is to provide a hat-type metal sheet pile, which has more than a 700 mm effective width and a superior cross-section performance to a metal sheet pile according to the background art.

The inventor of the present application has investigated the cross-sectional performances of U-type metal sheet and hat-type metal sheet piles according to the background art. FIG. 2 is a graph illustrating a cross-sectional performance of background art metal sheet pile. The horizontal axis includes W [$kg/m^2$], a metal sheet pile weight per unit area of the wall of metal sheet pile, and the vertical axis shows the geometrical moment of inertia I [$cm^4/m$]. The inventor of the present application has found that $I \leqq 470W-38{,}000$, wherein I has been calculated according to the following formula.

$$I_x = \int_A y^2 dA$$

In the above formula, y=the distance from the gravity-center axis and A=the cross-sectional area of the metal sheet pile.

In view of the above, it is also an object of the present invention to provide a hat-type metal sheet pile which has more than a 700 mm effective width and a geometrical moment of inertia I [$cm^4/m$] which is more than 470W−38,000.

The inventor of the present application has also examined the shape of a hat-type metal sheet pile which has a predetermined value of the geometrical moment of inertia I [$cm^4/m$] and a predetermined effective width B [mm] by changing a height of the hat-type metal sheet pile in order to obtain a shape which can obtain a geometrical moment of inertia I [$cm^4/m$], which is more than 470W−38,000.

It has been found by the present inventors that the following hat-type metal sheet pile meets the above conditions and therefore accomplished the objects of the present invention.

A metal sheet pile comprising:

a flange;

a pair of webs, each of said pair of webs being connected at one end thereof to opposite ends of said flange, respectively, so as to be line-symmetric with each other;

a pair of arms, each of said pair of arms being connected at one end thereof to another end of said pair of webs, respectively; and a pair of joints, each of said pair of joints being connected to another end of said pair of arms, respectively, wherein a cross-sectional dimension of said metal sheet pile meet all of the following inequalities:

$$700 \leqq B \leqq 1{,}200;$$

$$280 \leqq Bf \leqq 0.0005 \times B^2 - 0.05 \times B; \text{ and}$$

$$-0.073 \times B + 0.0043 \times I + 230 \leqq H \leqq 380,$$

where B is an effective width [mm] of said metal sheet pile, Bf is a width [mm] of said flange, H is a height [mm] of said metal sheet pile, and I is a geometrical moment of inertia [$cm^4$/m] of said metal sheet pile.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 illustrates evaluations of cross-sectional performance of various shapes of hat-type metal sheet piles;

DETAILED DESCRIPTION OF THE INVENTION

Figure 1:
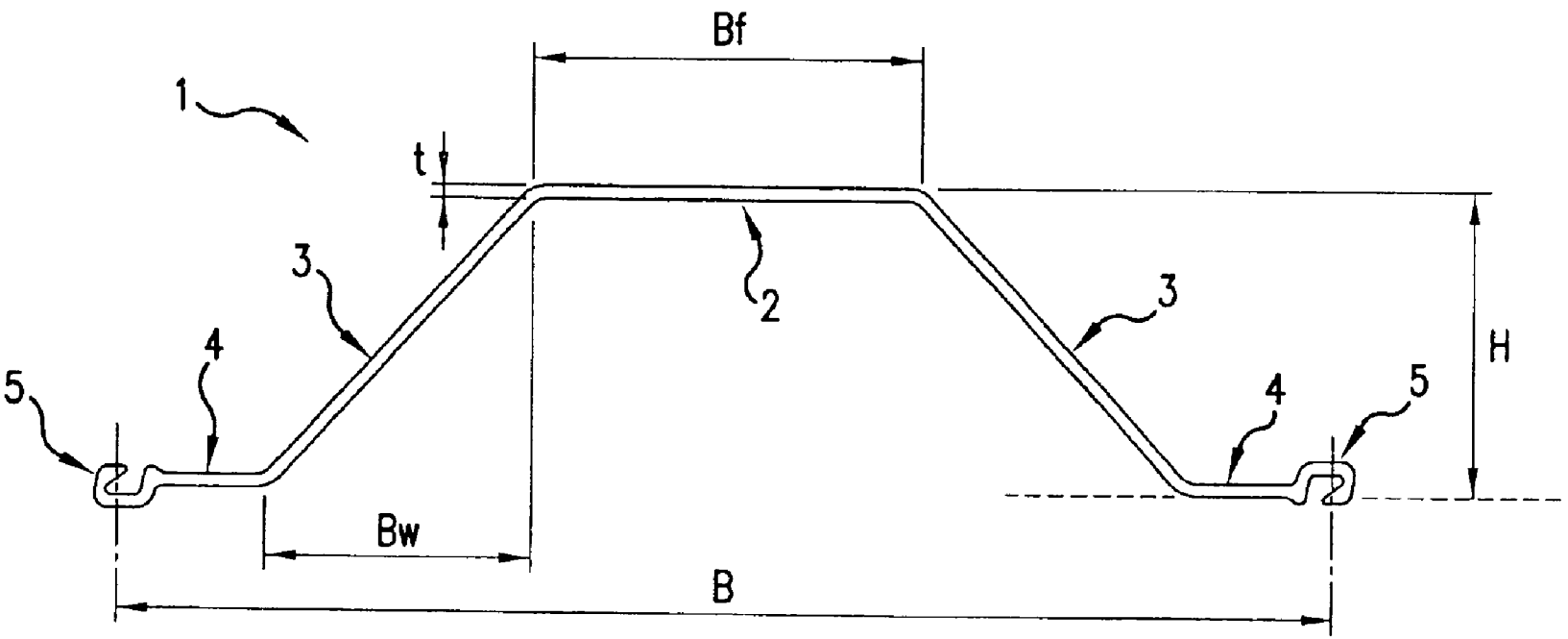
FIG. 1 is a cross-section of a hat-type metal sheet pile of the present invention.
Figure 2:
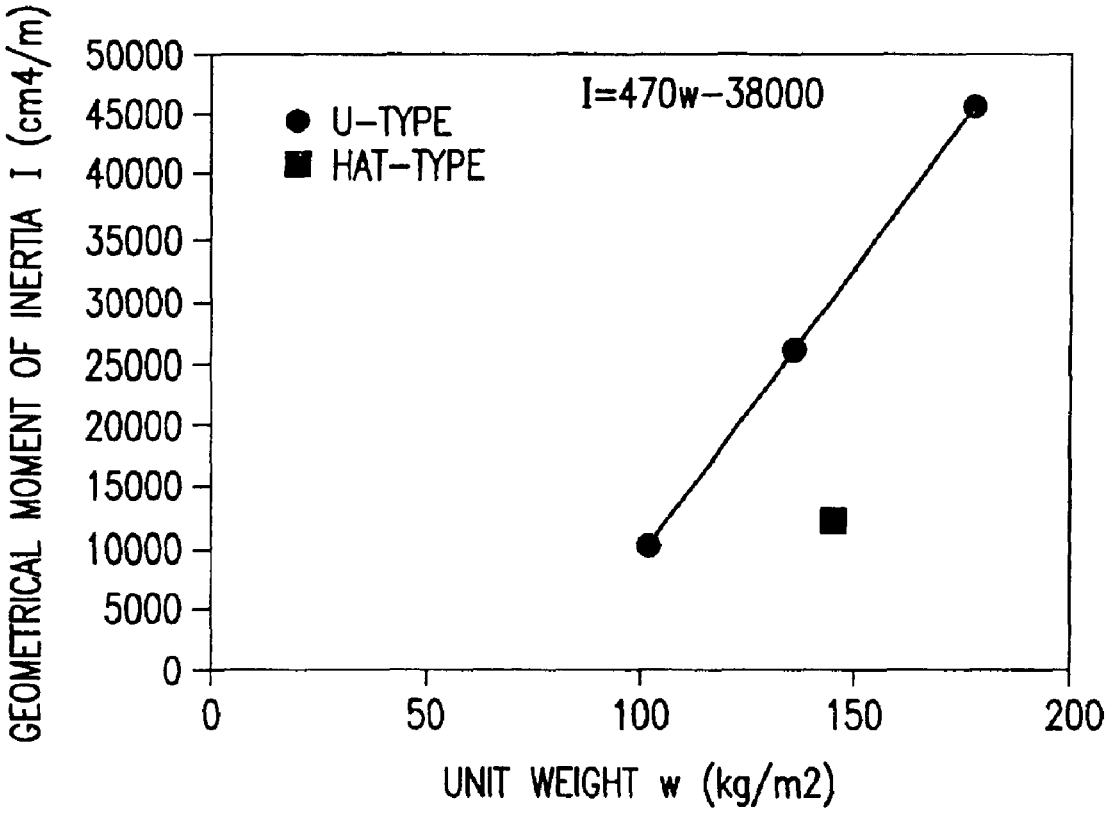
FIG. 2 is a graph indicating a relationship between a weight per unit area W [$kg/m^2$] of the metal sheet pile and a geometrical moment of inertia I [$cm^4$/m] in the background art metal sheet piles.

Referring to FIG. 1, a hat-type metal sheet pile of the present invention includes a flange 2, a pair of webs 3, 3, a pair of arms 4, 4 and a pair of joints 5, 5. Each of the pair of webs 3, 3 is connected to a respective end of the flange 2 so as to be line-symmetric with each other. Each of the pair of arms 4, 4 is connected at one thereof the other end of the pair of webs 3, 3, respectively. The pair of arms 4, 4 is parallel to the flange 2. Furthermore, each of the pair of joints 5, 5 is connected to the other end of the pair of arms 4,4, respectively.

FIG. 1 shows a hat-type metal sheet pile where an effective width is B mm, a height is H mm, a web width is Bw mm, a flange width is Bf mm and a flange thickness is t mm. The effective width B [mm] is defined as a distance between an interfitting center of a left joint 5 and an interfitting center of right joint 5. The interfitting center is defined as a center position of an area where a joint of one sheet pile and a joint of adjacent sheet pile overlap to interfit in the width direction of the sheet piles.

Figure 3:
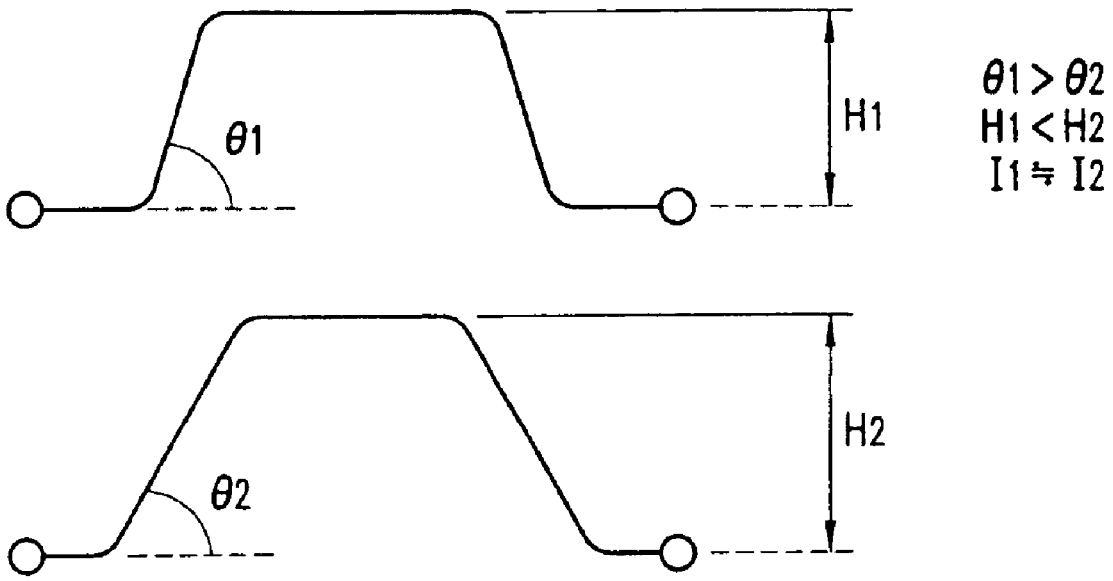
FIG. 3 illustrates two different shaped hat-type metal sheet piles with different height, which has approximately the same geometrical moment of inertia I [$cm^4$/m] and the same effective width B [mm]

It is possible to prepare two different shaped hat-type metal sheet piles having a different height and a different flange width, which still has the same geometrical moment of inertia I [$cm^4$/m] and the same effective width B [mm] by increasing the height H [mm], decreasing the flange width Bf [mm] and reducing a web angle (an angle θ [degrees] between an arm 4 and a web 3) in one sheet pile with respect to the other. An example is shown in FIG. 3.

A plurality of cross-sectional shapes of hat-type metal sheet piles, which have a predetermined value of I [$cm^4$/m] and a predetermined effective width B [mm], are determined by the following steps. First, one shape is tentatively fixed and I [$cm^4$/m] is calculated based on the shape. Second, if the calculated value of I [$cm^4$/m] is less than the predetermined value, a height of the shape is increased and/or a web angle is increased and then I [$cm^4$/m] is calculated again. If the calculated value is more than the predetermined value, a height of the shape is decreased and/or a web angle is decreased and then I [$cm^4$/m] is calculated. This calculation process is repeated until the calculated value becomes close enough to the predetermined value and to determine the final convergent shape. As a predetermined value of geometrical moment of inertia I [$cm^4$/m], 10,000 [$cm^4$/m], 25,000 [$cm^4$/m] and 45,000 [$cm^4$/m] were selected. As a predetermined effective width B [mm], 700 mm, 750 mm, 800 mm, 850 mm, 900 mm and 1,000 mm were selected. More precisely, first, a hat-type metal sheet pile having a geometric moment of inertia I of 10,000 [$cm^4$/m] and an effective width B of 700 mm is designed for a plurality of heights to determine the condition which meet the inequality I>470W−38,000. Second, a hat-type metal sheet pile with I of 10,000 [$cm^4$/m] and B of 750 mm is designed for a plurality of heights to determine the condition which meet the inequality I>470W−38,000. This operation is repeated with respect to other selected values of I [$cm^4$/m] and B [mm] mentioned above, and all the conditions (all the shapes) which meet the inequality I>470W−38,000 are obtained.

Figure 4:
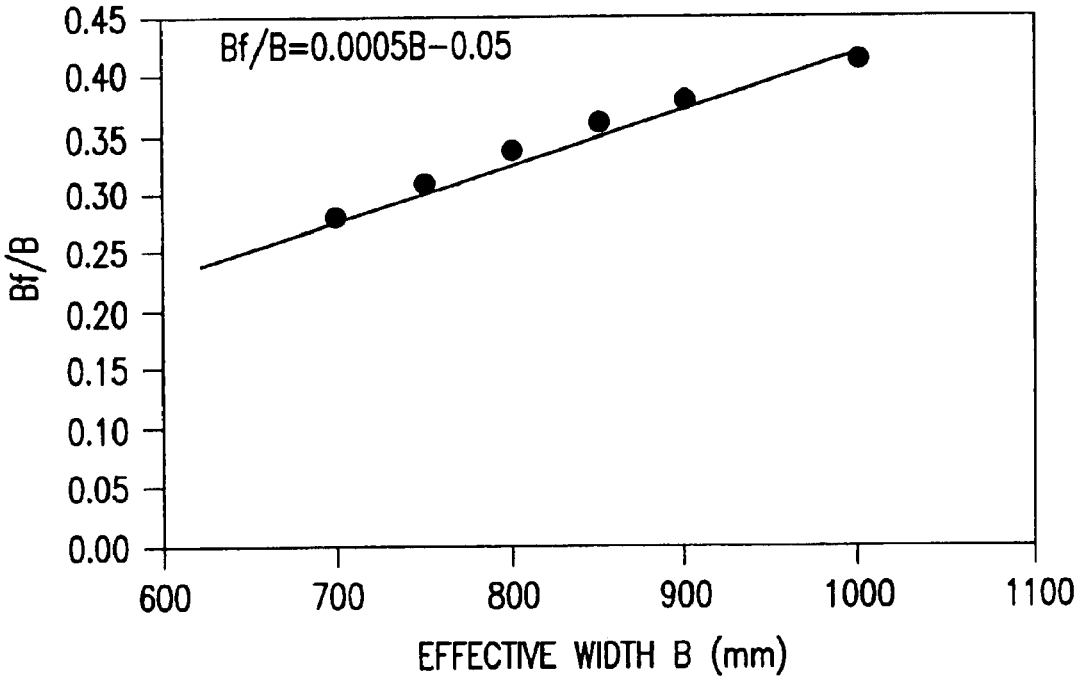
FIG. 4 is a graph illustrating a relationship between an effective width B [mm] and (a flange width Bf [mm])/(an effective width B [mm]) with respect to a hat-type metal sheet pile with a predetermined value of the geometrical moment of inertia I [$cm^4$/m] and a predetermined effective width B [mm], which meets the inequality I>470W−38,000.

FIG. 4 is a graph showing a relationship between the effective width B [mm] and (the flange width Bf [mm])/(the effective width B [mm]) with respect to a hat-type metal sheet pile with a predetermined value of I [$cm^4$/m] and a predetermined effective width B [mm], which meets the inequality I>470W−38,000. FIG. 4 illustrates the situation where I=10,000 [$cm^4$/m]. An area under the approximate line in the graph meets the inequality I>470W−38,000. In other words, it is found that when the effective width B [mm] and the flange width Bf [mm] meet the inequality Bf/B≦0.0005B−0.05, i.e., Bf≦0.0005B−0.05B, a hat-type metal sheet pile having a superior cross-sectional performance compared to a hat-type metal sheet pile according to the background art; namely, a geometrical moment of inertia I of more than (470W−38,000) can be obtained.

The relationship between the effective width B [mm] and the flange width Bf [mm] for meeting the inequality $I>470W-38{,}000$, i.e., $Bf/B \leqq 0.0005B-0.05$ or $Bf \leqq 0.0005B^2-0.05B$ is independent of the value of geometrical moment of inertia I [$cm^4/m$]. This relationship is unexpected.

The aforementioned relationship between the effective width B [mm] and the flange width Bf [mm] was derived from examining the shape of a hat-type metal sheet pile which has a predetermined value of the geometrical moment of inertia I [$cm^4/m$] and a predetermined effective width B [mm] by changing a height of the hat-type metal sheet pile. As long as the height is more than a certain value, the inequality; $I>470W$ 38,000 is met and the relationship between B and Bf is $Bf/B \leqq 0.0005B-0.05$ or $Bf \leqq 0.0005B^2-0.05B$.

In a hat-type metal sheet pile with a given effective width B [mm], when the flange width Bf and the web angle (an angle θ [degrees] between the arm and the web) are reduced while maintaining a height of the metal sheet pile, the geometrical moment of inertia I [$cm^4/m$] becomes small, i.e., the cross-sectional performance becomes poor even if the relationship between B and Bf is $Bf/B \leqq 0.0005B-0.05$ or $Bf \leqq 0.0005B^2-0.05B$.

After further studying, it was also found that there is another specific relationship between the effective width B [mm] and the height H [mm] of the metal sheet pile in addition to the relationship between B and Bf, i.e., $Bf/B \leqq 0.0005B-0.05$ or $Bf \leqq 0.0005B^2-0.05B$ to obtain a better cross-sectional performance than a background art metal sheet pile.

Figure 5:
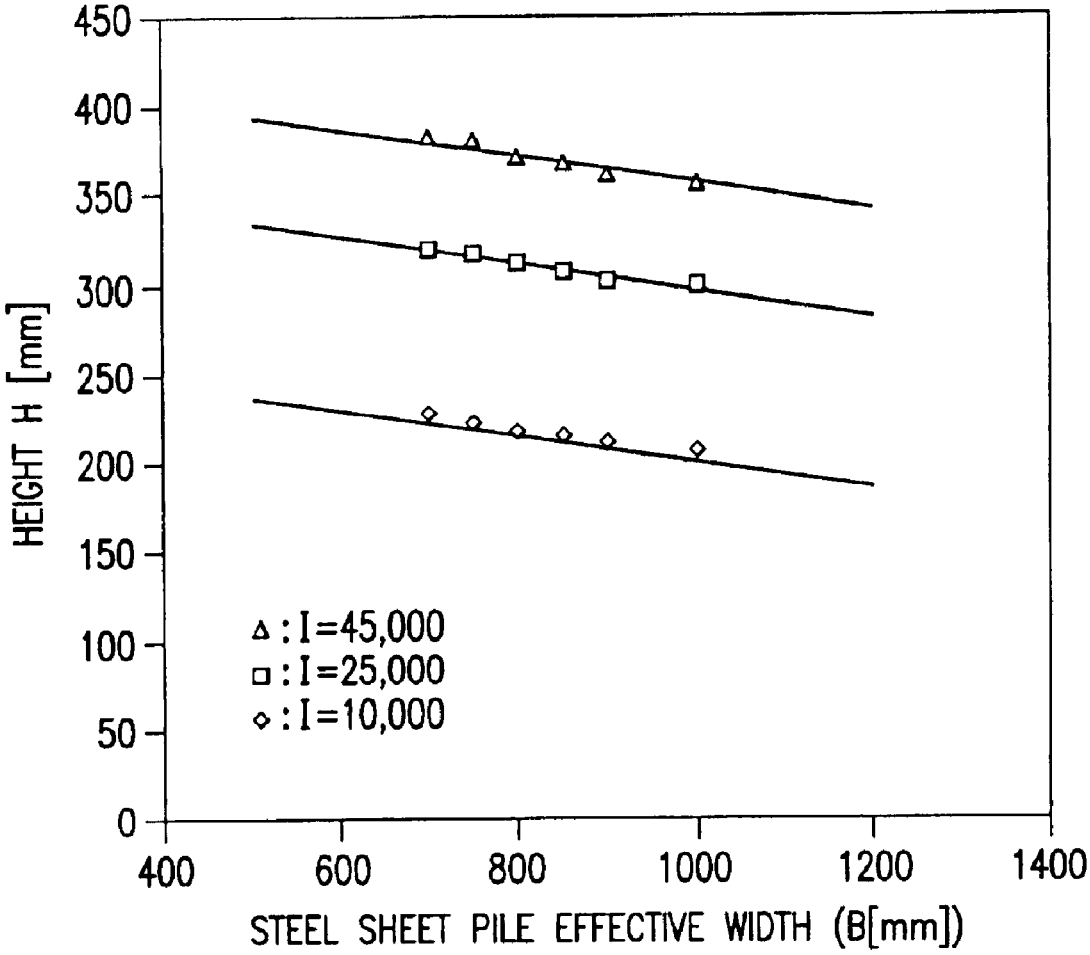
FIG. 5 is a graph illustrating a relationship between an effective width B [mm] and a height H [mm] with respect to a hat-type metal sheet pile with a predetermined value of the geometrical moment of inertia I [$cm^4$/m] and a predetermined effective width B [mm], which meets the inequality I>470W−38,000.

FIG. 5 is a graph showing a relationship between the effective width B [mm] and a lower limit of the height H [mm] to meet the relation of the inequality; $I>470W-38{,}000$ with respect to predetermined values of the geometrical moment of inertia I [$cm^4/m$] and predetermined values of the effective width B [mm].

If the height H [mm] of the metal sheet pile meets the inequality $-0.073\times B+0.0043\times I+230 \leqq H$ and another inequality $Bf/B \leqq 0.0005B-0.05$ is met, a hat-type metal sheet pile having a better cross performance than background art metal sheet pile can be obtained. In other words, if $I>470W-38{,}000$ is met, an improved hat-type metal sheet pile can be obtained. It has also been confirmed that the above result remains almost unchanged in the range of flange thickness t [mm] from 10 mm to 28 mm.

Other shape factors of a hat-type metal sheet pile contributing to a better cross-sectional performance are described below. In a hat-type metal sheet pile, as long as a cross-sectional area is the same, the geometrical moment of inertia I becomes a maximum if the sheet pile is designed so that the gravity-center axis can be positioned in the middle of the height of the metal sheet pile. In view of this, the following inequality gives an approximate solution, which may slightly changed depending on the weight of the joint of the sheet pile:

$Bf\times 0.6 \leqq B-Bf-Bw\times 2 \leqq Bf\times 1.1$, wherein Bf is the flange width and B is the effective width.

Figure 9:
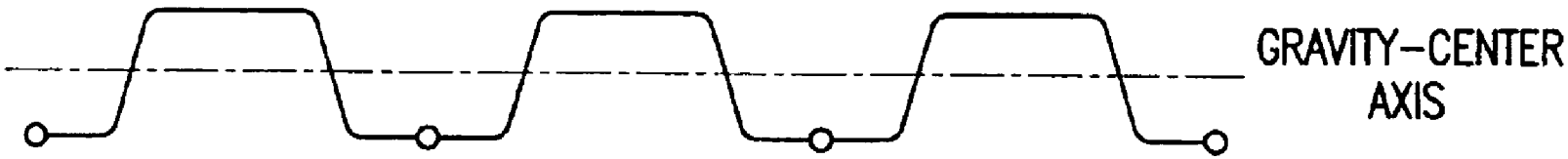
FIG. 9 illustrates outlines of several hat-type metal sheet piles, which are interlocked one after another to form a continuous metal wall.

FIG. 9 illustrates outlines of several hat-type metal sheet piles, which are interlocked one after another to form a continuous metal wall. If the inequality; $Bf\times 0.6 \leqq B-Bf-Bw\times 2 \leqq Bf\times 1.1$ is met, the gravity-center axis can be positioned approximately in the middle of the height of the metal sheet piles.

The height H [mm] of a metal sheet pile is normally restricted to less than 380 mm because a metal sheet pile is manufactured by rolling a slab and an effective roll diameter of the rolling facility is restricted. In addition, the effective width B [mm] and the flange thickness t [mm] are limited to less than 1,200 mm and 28 mm, respectively, because of a limited rolling load capacity.

Figure 6:
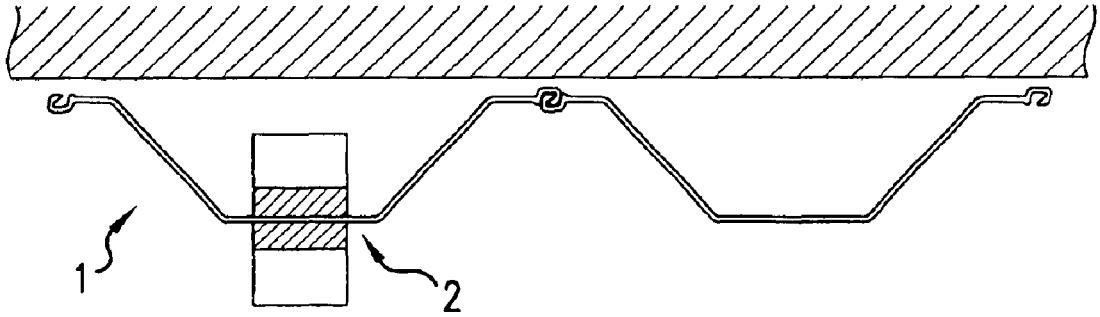
FIG. 6 illustrates a hat-type metal sheet pile and a vibrohammer chucking the metal sheet pile.
Figure 8A:
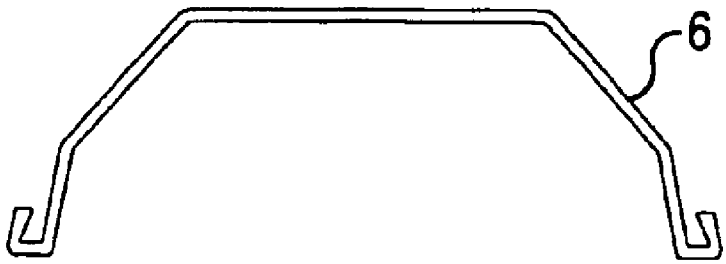
FIGS. 8A and 8B illustrate outlines of a U-type metal sheet pile and a hat-type metal sheet pile.
Figure 8B:
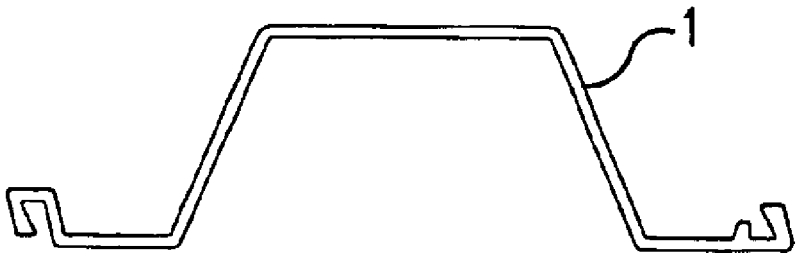

When driving into a metal sheet pile, the flange portion of the metal sheet pile needs to be chucked by a vibrohammer. FIG. 6 illustrates a hat-type metal sheet pile and a vibrohammer chucking the sheet pile. Normally, a chucking device of a vibrohammer is 200–250 mm wide. Therefore the flange width should be more than 280 mm to allow for the chucking width of the vibrohammer, with a margin on each side remaining.

If the ratio of the flange width Bf [mm]/the flange thickness t [mm] is large, an applied load for driving the hat-type sheet pile may cause a local buckling or a local buckling may occur while the metal sheet piles are used as a wall, since the wall may collapse. To avoid local buckling, the ratio, of the flange width Bf [mm]/the flange thickness t [mm] should be less than 32.4.

An example of the shape of a hat-type metal sheet pile which meets all of the requirements or desired conditions set forth above can be determined as follows, where the hat-type metal sheet pile has a geometrical moment of inertia of 9,500–10,500 [$cm^4/m$] and an effective width B of 890–920 [mm]. If the flange width Bf [mm] meets the condition $280 \leqq Bf \leqq 350$, the condition $280 \leqq Bf \leqq 0.0005\times B^2-0.05\times B$ is always met, and if the height H is more than 210 [mm], the condition $-0.073\times B+0.0043\times I+230 \leqq H \leqq 380$ is always met (Upper limit of the height H could be 380 [mm] but actually 350 [mm] would be recommended for easier manufacturing.), then tentative values of the flange width Bf and the height H are determined so that the inequality $Bf\times 0.6 \leqq B-Bf-Bw\times 2 \leqq Bf\times 1.1$ can be met, and a geometrical moment of inertia I can be calculated. If the calculated value of the geometrical moment of inertia I is less than 9,500–10,500, the tentatively determined height and/or web angle can be changed to larger value to repeat the same calculation. If the calculated value of the geometrical moment of inertia I is more than 9,500–10,500, the tentatively determined height and/or web angle can be changed to smaller value to repeat the same calculation. These operations are repeated until the calculated value of I falls into the range of 9,500–10,500. The final shape of the sheet pile can then be fixed.

In view of the above, the present inventors have found that a hat-type metal sheet pile having an effective width of more than 700 mm and excellent cross-section performance, which has never been on the market, can be produced by designing the shape of the sheet pile so that the effective width B is between 700 and 1200 mm, the flange width Bf can meet the inequality condition $280 \leqq Bf \leqq 0.0005\times B^2-0.05\times B$, and the height H can meet another inequality condition $-0.073\times B+0.0043\times I+230 \leqq H \leqq 380$.

Evaluations of Present Examples of the Invention and Comparative Examples:

Some examples of hat-type metal sheet piles have been designed so as to meet the following three conditions. Other hat-shaped metal sheet piles have been designed for comparison without meeting some of the three conditions.

The Three conditions are:

(1). With respect to an effective width B [mm], $$700 \leqq B \leqq 1{,}200;$$

(2). With respect to a flange width Bf [mm], $$280 \leqq Bf \leqq 0.0005 \times B^2 - 0.05 \times B,$$

$$Bf \times 0.6 \leqq B - Bf - Bw \times 2 \leqq Bf \times 1.1; \text{ and}$$

(3). With respect to a height H [mm], $$-0.073 \times B + 0.0043 \times I + 230 \leqq H \leqq 380.$$

The evaluation data for the Examples of the present invention and the Comparative Examples is shown in FIG. 7. FIG. 7 indicates the a hat-type metal sheet pile which meets the three conditions (examples 1–9) has a superior cross-sectional performance to that of a background art metal sheet pile, and a hat-type metal sheet pile without meeting some of the three conditions (comparative examples 10–16) are inferior to a background art metal sheet pile with respect to the cross-sectional performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A steel sheet pile comprising:

a flange;

a pair of webs, each of said pair of webs being connected at one end thereof to opposite ends of said flange, respectively, so as to be line-symmetric with each other;

a pair of arms, each of said pair of arms being connected at one end thereof to another end of said pair of webs, respectively; and a pair of joints, each of said pair of joints being connected to another end of said pair of arms, respectively, wherein the sheet pile has a geometrical moment of inertia I of at least 9,500 [$cm^4$/m] and a cross-sectional dimension of said sheet pile meets all of the following inequalities:

$$890 \leqq B \leqq 920;$$

$$280 \leqq Bf \leqq 350;$$

$$210 \leqq H \leqq 350; \text{ and}$$

$$Bf/32.4 \leqq t \leqq 28,$$

where B is an effective width [mm] of said sheet pile, Bf is a width [mm] of said flange, H is a height [mm] of said sheet pile, and t is a flange thickness [mm] of said sheet pile.

2. The steel sheet pile according to claim 1, wherein the cross-sectional dimension of said sheet pile further meets the inequality $Bf \times 0.6 \leqq B - Bf - 2 \times Bw \leqq Bf \times 1.1$, where Bw is a width [mm] of said webs in the direction parallel to said flange.

3. The steel sheet pile according to claim 2, wherein the thickness of the flange is less than 28 mm.

4. The steel sheet pile according to claim 1, wherein said pair of arms are parallel to said flange.

5. The steel sheet pile according to claim 1, wherein said steel metal pile is hot-rolled.

6. The steel sheet pile according to claim 1, wherein said steel sheet pile has a moment of inertia of 9,500–10,500 $cm^4$/m.

7. The steel sheet pile according to claim 1, wherein the thickness of the flange is from 10 mm to 28 mm.

8. The steel sheet pile according to claim 1, wherein said sheet pile meets the following inequality:

$$I > 470W - 38000,$$

wherein W is the weight per unit area ($kg/m^2$) of the metal sheet pile.

* * * * *